United States Patent [19]

Fischer

[11] Patent Number: 4,844,500

[45] Date of Patent: Jul. 4, 1989

[54] SKI

[75] Inventor: Josef Fischer, Ried im Innkreis, Austria

[73] Assignee: Fischer Gesellschaft m.b.H., Ried im Innkreis, Austria

[21] Appl. No.: 74,067

[22] Filed: Jul. 2, 1987

Related U.S. Application Data

[62] Division of Ser. No. 760,878, Jul. 31, 1985, abandoned.

[30] Foreign Application Priority Data

Aug. 1, 1984 [AT] Austria ..... 2484/84

[51] Int. Cl.[4] ..... A63C 5/04

[52] U.S. Cl. ..... 280/604; 280/610.1

[58] Field of Search ..... 280/604, 610; 428/323, 428/327

[56] References Cited

U.S. PATENT DOCUMENTS

| | | | |
|---|---|---|---|
| 4,564,210 | 1/1986 | Case | 280/604 |
| 4,595,215 | 6/1986 | Tiitola | 280/610 |

FOREIGN PATENT DOCUMENTS

| | | |
|---|---|---|
| 0086939 | 8/1983 | European Pat. Off. . |
| 546898 | 3/1932 | Fed. Rep. of Germany . |
| 2110737 | 8/1972 | Fed. Rep. of Germany . |
| 2802802 | 7/1979 | Fed. Rep. of Germany . |
| 253733 | 3/1948 | France . |

*Primary Examiner*—David M. Mitchell
*Assistant Examiner*—Richard Camby
*Attorney, Agent, or Firm*—Fleit, Jacobson, Cohn & Price

[57] ABSTRACT

A ski, particularly suitable for cross-country skiing having a coating on at least a portion of the running surface thereof. The coating is of a basic material and has at least one portion including at least one further material. The basic material and the at least one further material have different hardness values. The basic material is a thermoplastic material and at least one of the further materials is an elastomeric material. The elastomeric material may be embedded in the thermoplastics material in the form of insert members. The invention also relates to a ski-shaped coating for application to a ski.

2 Claims, 2 Drawing Sheets

SKI

This is a divisional of application Ser. No. 760,878, filed July 31, 1985 abandoned.

FIELD OF THE INVENTION

The present invention relates to a ski having a coating at least on part of its running surface, which coating, at least in one region, comprises a combination of at least two materials of different hardness. The invention also relates to a coating for a ski. Such a coating is primarily, but not essentially, intended for use in or on skis used for Nordic-type skiing events, such as cross-country races and biathlon events.

BACKGROUND OF THE INVENTION AND PRIOR ART DISCUSSION

The development of coating for skis has been somewhat complex. Thus, for example attempts have been made to optimise, simultaneously, both the gliding properties and the adhesion properties of coatings, which properties appear, at first sight, to be mutually incompatible. Many different factors need to be taken into account. In skis used for long-distance races, the behaviour of the coating when the skier is pushing-off and when climbing have to be considered. In addition, the condition of the snow, which may be wet, dry, icy or powdery, must also be taken into consideration.

In coatings known hitherto, elastomeric materials have largely been used with a proportion of fibre components included therein. In such cases, the basic material of the coating for the running surface of the ski has been formed from a soft material such as an elastomeric material having insert members included therein. The insert members are formed from a harder material such as a thermoplastics material. However, coatings of this type have not produced entirely satisfactory results.

OBJECT OF THE INVENTION

The present invention seeks to provide a coating for the running surface of a ski having optimised gliding, climbing and push-off properties.

SUMMARY OF THE INVENTION

According to the present invention there is provided a ski, particularly suitable for long-distance skiing comprising a tread surface and a coating covering at least a portion of said tread surface, said coating comprising a first basic material having a first hardness value, said basic material, in at least one portion of said coating, including at least one further material having a second hardness value, said first and second hardness values differing from one another, wherein said first material is a thermoplastics material and at least one of said further materials is an elastomeric material.

Also according to the present invention, there is provided a ski-shaped coating for application to at least a part of a ski comprising a basic material portion having a first hardness value adapted to the configuration of at least a part of the running surface of a ski to which the coating is to be applied, said basic material portion defining at least one further region, said basic material portion, in said at least one further region, including at least one further material having a second hardness value, said hardness values differing from one another, wherein said basic material is a thermoplastics material and at least one of said further materials is an elastomeric material.

It has surprisingly been found that such a coating does not require any further mechanical treatment nor is it necessary to apply wax thereto although, of course, such treatment or wax application can be effected if desired. The coating of the present invention, which is, effectively, the reverse of the known coating, means that the gliding properties of the thermoplastics material are still effectively utilised, while the elastomeric material provides the grip which is necessary for enabling the skier to push-off effectively.

BRIEF DESCRIPTION OF THE DRAWINGS

The invention will be further described, by way of example, with reference to the accompanying drawings which illustrate various embodiments of a ski having a coating in accordance with the present invention. In the drawings.

DESCRIPTION OF PREFERRED EMBODIMENTS

Figure 1:
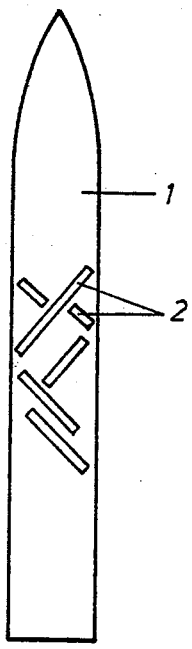
FIGS. 1 to 4 are similar views of the underside of a ski having different arrangements of coatings formed thereon and FIGS. 5 to 10 illustrate, in greater detail, the construction of the coating.
Figure 2:
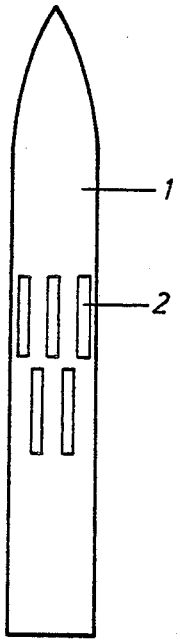
Figure 3:
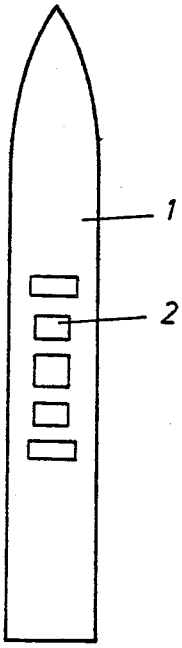

In FIG. 1, there is shown a ski having a surface coating formed thereon. The coating comprises a basic material 1 which is of a hard thermoplastics material. A soft elastomeric material is embedded in the thermoplastics material 1 in the form of insert members 2. The insert members 2 are preferably only provided in one zone of the ski. This zone is used when the skier is climbing and occupies a maximum of 45% of the total surface of the ski. Such zone is located generally in the central region of the ski beneath the ski binding (not shown). In the embodiments shown in FIGS. 2 and 3, two further ways in which the insert members 2 may be included in the basic elastomeric material 1 are shown.

Figure 4:
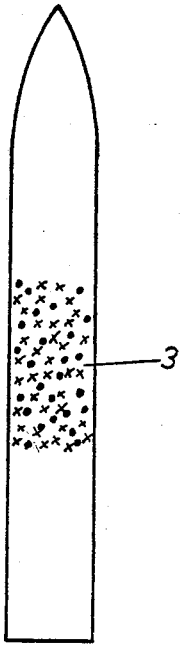

In all three of the above-described embodiments, the elastomeric material is present in the form of insert members. However, in a further embodiment of the invention, as shown in FIG. 4, the elastomeric material and the thermoplastics material are in the form of a mixture from which, preferably, only the zone 3 of the ski is used when the skier is climbing. Although shown arranged in a substantially random manner in FIG. 4, the mixture may be laid or formed in longitudinal, centrally disposed strips.

Additional substances, materials or the like may also, of course, be added to the mixture. Such an addition may be in the form of micro-spheres such as small hollow glass balls having a diameter lying within the range of about 0.04 mm to about 0.1 mm, or fibres, such as plastics material fibres, glass fibres, Aramid fibres or even powders or other granular material. These additional materials may be provided to roughen the coating slightly. This affects the properties of the ski and the choice of the additional material depends upon the intended use of the ski and the terrain to be covered. This is particularly true in Nordic skiing races where there is no standardised course and the type of terrain and the type of snow will vary from one course to another. Waxes, such as paraffin waxes, may also be introduced into the coating, if desired, as may other materials such as a granular material.

Figure 5:
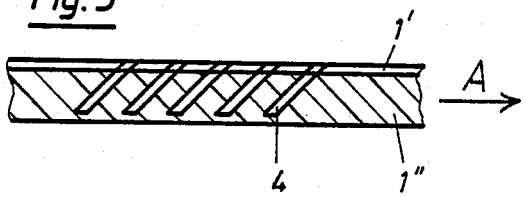

In FIG. 5, a coating having aligned fibres included therein is illustrated. The coating may be, for example, 1.2 mm thick and the thermoplastics material portion may be formed from two layers 1' and 1''. The layer 1' is, in such a case, a support web. Fibres 4 are included therein which extend at an angle of about 30° to about 45° to the support web and being orientated in the direction of travel A. The fibres 4 may be formed from highly wear-resistant material and may protrude slightly beyond the coating. These fibres generally have a diameter of from about 0.02 mm to about 0.1 mm, preferably 0.05 mm. There will generally be between 25 to 50 fibres per square centimeter of surface area. Although shown in this Figure as being in the thermoplastics material portion of the coating, the fibres can equally easily be disposed in the elastomeric material or even in both the thermoplastic material and in the elastomeric material.

Figure 6:
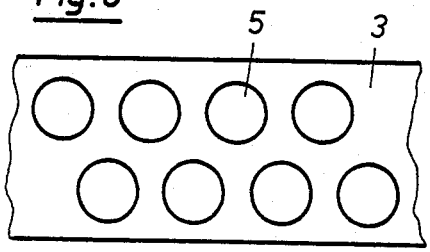
Figure 7:
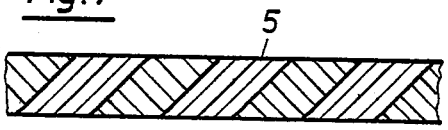

In FIG. 6, a coating is illustrated which is provided in its climbing zone 3 with holes or recesses 5 which, as can be seen in the cross-sectional view of FIG. 7, may be inclined with respect to the surface of the ski. These holes or recesses are filled with an elastomeric material, whilst the remaining portion is formed from thermoplastics material.

Figure 8:
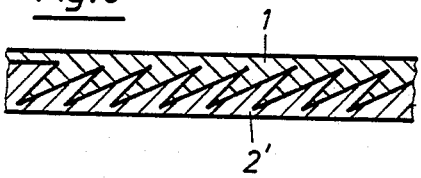

FIG. 8 illustrates an embodiment wherein the coating is extruded from a thermoplastics material and is provided with a core-like configuration which defines teeth and grooves. The elastomeric material 2' is added thereto and is retained in position by the teeth and grooves.

Figure 9:
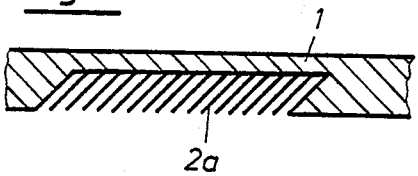

FIG. 9 illustrates a thermoplastic surface coating 1 in which lamellar profiles *2a* are embedded or incorporated. These profiles *2a* are formed from an elastomeric material and are inclined at an angle of from about 30° to about 40° with respect to the direction of travel A.

Figure 10:
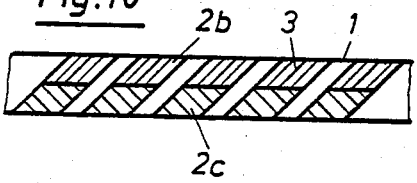

In the embodiment of the coating shown in FIG. 10, at least a part of the elastomeric portion of the coating in the climbing zone 3 is formed from two layers *2b* and *2c* of elastomeric materials having differing hardnesses. The layer *22b* is formed from a harder elastomeric material than the layer *2c*. The layer *2c* may possibly be temperature-dependent. As illustrated, a fibrous material is incorporated in the two layers, such fibres being formed from a wear-resistant material and, as shown, being inclinedly orientated relative to the direction of travel in a manner similar to that described with reference to FIG. 5.

If fibres are included, they may, as stated hereinbefore, protrude beyond the coating. In such a case, the protruding tips of the fibres 4 extend generally in the direction of travel of the ski as is shown, for example, in FIG. 5.

The material embedded or incorporated in the coating may be secured in the embedding material in a form-fitting manner or in any other suitable manner.

If a plurality of layers are used, the fibres in the individual layers may also extend in different directions.

A coating according to the present invention does not necessitate the cutting or stamping of steps in the ski, nor does it necessitate the application of wax thereto. By the use of thermoplastics material, the coating has excellent gliding properties and the use of the elastomeric material gives the coating excellent grip for climbing purposes. Moreover, such a coating is also wear-resistant.

I claim:

1. A running surface for a ski, said running surface having a coating provided on at least a portion thereof, said coating comprising a mixture of a thermoplastic material and particles of an elastomeric material, said particles of elastomeric material being embedded in at least one portion said thermoplastic material, and said thermoplastic material having a higher hardness value than said elastomeric material.

2. A ski comprising a running surface and a coating provided on at least a portion of said running surface, said coating comprising a mixture of a thermoplastic material and particles of an elastomeric material, said particles elastomeric material being embedded in at least one portion of said thermoplastic material, and said thermoplastic material having a higher hardness value than said elastomeric material.

* * * * *